US005510674A

United States Patent [19]

Kyushima et al.

[11] Patent Number: 5,510,674

[45] Date of Patent: Apr. 23, 1996

[54] PHOTOMULTIPLIER

[75] Inventors: Hiroyuki Kyushima; Koji Nagura; Yutaka Hasegawa; Eiichiro Kawano; Tomihiko Kuroyanagi; Akira Atsumi; Masuya Mizuide, all of Hamamatsu, Japan

[73] Assignee: Hamamatsu Photonics K.K., Hamamatsu, Japan

[21] Appl. No.: 234,157

[22] Filed: Apr. 28, 1994

[30] Foreign Application Priority Data

| | | | |
|---|---|---|---|
| Apr. 28, 1993 | [JP] | Japan | 5-102898 |
| Apr. 28, 1993 | [JP] | Japan | 5-102902 |
| Apr. 28, 1993 | [JP] | Japan | 5-102910 |
| Apr. 30, 1993 | [JP] | Japan | 5-104667 |
| Apr. 30, 1993 | [JP] | Japan | 5-104668 |
| Apr. 30, 1993 | [JP] | Japan | 5-104673 |

[51] Int. Cl.[6] ..... H01J 43/18

[52] U.S. Cl. ..... 313/533; 313/534

[58] Field of Search ..... 313/533, 534, 313/535

[56] References Cited

U.S. PATENT DOCUMENTS

| | | | |
|---|---|---|---|
| 3,229,143 | 1/1966 | Bartschat | 313/105 R |
| 4,023,063 | 5/1977 | King et al. | 313/400 |
| 4,362,692 | 12/1982 | Greenaway | 376/265 |
| 4,395,437 | 7/1983 | Knapp | 427/78 |
| 4,577,137 | 3/1986 | Kaiser | 313/533 |
| 4,604,545 | 8/1986 | McDonie et al. | 313/150 CM |
| 4,998,037 | 3/1991 | Kerkhof et al. | 313/103 CM |
| 5,365,807 | 11/1994 | Darrah et al. | 81/60 |

FOREIGN PATENT DOCUMENTS

| | | | |
|---|---|---|---|
| 0068600 | 1/1983 | European Pat. Off. | H01J 1/88 |
| 0078078 | 5/1983 | European Pat. Off. | H01J 43/24 |
| 2481004 | 10/1981 | France . | |
| 1539957 | 10/1969 | Germany . | |
| 59-151741 | 8/1984 | Japan | H01J 43/22 |
| 1405256 | 9/1975 | United Kingdom | H01J 31/50 |

OTHER PUBLICATIONS

Eames et al. "Gas Display Panel Spacer Rod Grooves" IBM Technical Disclosure Bulletin vol. 19 No. 8 Jan. 1977.

*Primary Examiner*—Donald J. Yusko
*Assistant Examiner*—Lawrence D. Richardson
*Attorney, Agent, or Firm*—Cushman Darby & Cushman

[57] ABSTRACT

A photomultiplier comprising an electron multiplier for minimizing a variation in multiplication factor and noise is characterized in that insulating members are aligned on the same line to insulate a plurality of dynode plates for constituting a dynode unit from each other, thereby preventing a damage to each dynode plate. At the same time, a through hole is formed to fix the insulating member provided to each dynode plate such that a gap is provided between the major surface of the dynode plate and the surface of the insulating member, thereby preventing discharge between dynode plates, which is caused due to dust or the like deposited on the surface of the insulating member.

41 Claims, 10 Drawing Sheets

PHOTOMULTIPLIER

BACKGROUND OF THE INVENTION

1. Field of the Invention

The present invention relates to a photomultiplier and, more particularly, to an electron muitlplier for constituting the photomultiplier and cascade-multiplying an incident electron flow or ions by multilayered dynodes.

2. Related Background Art

In a conventional electron multiplier, a plurality of dynodes are multilayered at predetermined intervals to constitute a dynode unit for cascade-multiplying an incident electron flow. In U.S. Pat. No. 3,229,143, insulating balls are inserted between dynodes to constitute a dynode unit. FIG. 1 shows the main part of this structure. A through hole 103 is formed in each support plate 101 for supporting the corresponding stage of dynodes. An insulating ball 102 having part thereof fit in the opening ends of each through hole 103 is inserted between each pair of support plates 101. The insulating ball 102 is formed of pyrex and has a diameter larger than the inner diameter of the through hole 103. On the other hand, the through hole 103 forms a cylindrical hole having a predetermined inner diameter.

SUMMARY OF THE INVENTION

It is one of the objects of the present invention to provide a structure in which plates for supporting dynodes are held at predetermined intervals to minimize variation in multiplication factor and noise and prevent discharge between the dynode plates.

In the conventional structure, an acute- or right-angled edge portion (contact portion to the insulating member 102) is formed at the opening end of the through hole 103. When this portion is brought into contact with the insulating ball 102, pressed in a stacking direction, and deformed, burrs can be formed at the edge portion. When the edge portion which is in contact with the insulating ball 102 is deformed, the distance between the adjacent support plates 101 decreases. Even if this phenomenon slightly occurs at the edge portions of all the through holes 103, the intervals between the dynodes vary to cause a variation in multipiication factor (gain). In addition, due to those burrs, a field concentration occurs at the edge portions to generate noise.

According to the present invention, there is provided a photomultiplier structure capable of solving these problems.

Further, when a force is applied to the insulating balls 102 in the stacking direction, a pressure is applied to the support plates 101 through the insulating balls 102. As a result, the dynodes formed integral with the support plates 101 are deflected. This also makes the intervals between the dynodes nonuniform.

The present invention has a structure also effective in this situation.

A photomultiplier according to the present invention comprises a photocathode and an electron multiplier including an anode and a dynode unit arranged between the anode and the photocathode.

The electron multiplier is mounted on a base member and arranged in a housing formed integrally with the base member for fabricating a vacuum container. The photocathode is arranged inside the housing and deposited on the surface of a light receiving plate provided to the housing. At least one anode is supported by an anode plate and arranged between the dynode unit and the base member. The dynode unit is constituted by stacking a plurality of stages of dynode plates for respectively supporting at least one dynode for receiving and cascade-multiplying photoelectrons emitted from the photocathode in an incidence direction of the photoelectrons.

The housing may have deposited on an inner wall thereof a conductive metal for applying a predetermined voltage to the photocathode and rendered conductive by a predetermined conductive metal to equalize the potentials of the housing and the photocathode.

The photomultiplier according to the present invention has at least one focusing electrode between the dynode unit and the photocathode. The focusing electrode is supported by a focusing electrode plate. The focusing electrode plate is fixed on the electron incident side of the dynode unit through insulating members. The focusing electrode plate has holding springs and at least one contact terminal, all of which are integrally formed with this plate. The holding springs are in contact with the inner wall of the housing to hold the arrangement position of the dynode unit fixed on the focusing electrode plate through the insulating members. The contact terminal is in contact with the photocathode to equalize the potentials of the focusing electrodes and the photocathode. The contact terminal functions as a spring.

A plurality of anodes may be provided to the anode plate, and electron passage holes through which secondary electrons pass are formed in the anode plate in correspondence with positions where the secondary electrons emitted from the last-stage of the dynode unit reach. Therefore, the photomultiplier has, between the anode plate and the base member, an inverting dynode plate for supporting at least one inverting dynode in parallel to the anode plate. The inverting dynode plate inverts the orbits of the secondary electrons passing through the anode plate toward the anodes. The diameter of the electron incident port (dynode unit side) of the electron passage hole formed in the anode plate is smaller than that of the electron exit port (inverting dynode plate side). The inverting dynode plate has, at positions opposing the anodes, a plurality of through holes for injecting a metal vapor to form at least a secondary electron emitting layer on the surface of each dynode of the dynode unit.

On the other hand, the photomultiplier according to the present invention may have, between the inverting dynode plate and the base member, a shield electrode plate for supporting at least one shield electrode in parallel to the inverting dynode plate. The shield electrode plate inverts the orbits of the secondary electrons passing through the anode plate toward the anodes. The shield electrode plate has a plurality of through holes for injecting a metal vapor to form at least a secondary electron emitting layer on the surface of each dynode of the dynode unit. In place of this shield electrode plate, a surface portion of the base member opposing the anode plate may be used as an electrode and substituted for the shield electrode plate.

In particular, the electron multiplier comprises a dynode unit constituted by stacking a plurality of stages of dynode plates, the dynode plates spaced apart from each other at predetermined intervals through insulating members in an incidence direction of the electron flow, for respectively supporting at least one dynode for cascade-multiplying an incident electron flow, and an anode plate opposing the last-stage dynode plate of the dynode unit through insulating members. Each dynode plate has a first concave portion or depression in which a first insulating member, which is provided on the first main surface of the dynode plate partially contacts the first concave portion or depression and a second concave portion in which a second insulating member, which is provided on the second main surface of the dynode plate, partially contacts the second concave portion (the second concave portion communicates with the first concave portion through a through hole). The first insulating member disposed on the first concave portion and the second insulating member disposed on the second concave portion contact each other in the through hole. An interval between the contact portion between the first concave portion and the first insulating member and the contact portion between the second concave portion and the second insulating member is smaller than that between the first and second main surfaces of the dynode plate. The above concave portion can be provided in the anode plate, the focusing plate, inverting dynode plate and the shield electrode plate.

Important points to be noted in the above structure will be listed below. The first point is that gaps are formed between the surface of the first insulating member and the main surface of the first concave portion and between the second insulating member and the main surface of the second concave portion, respectively, to prevent discharge between the dynode plates. The second point is that the central point of the first insulating member, the central point of the second insulating member, and the contact point between the first and second insulating members are aligned on the same line in the stacking direction of the dynode plates so that the intervals between the dynode plates can be sufficiently kept.

Using spherical or circularly cylindrical bodies as the first and second insulating members, the photomultiplier can be easily manufactured. When circularly cylindrical bodies are used, the outer surfaces of these bodies are brought into contact with each other. The shape of an insulating member is not limited to this. For example, an insulating member having an elliptical or polygonal section can also be used as long as the object of the present invention can be achieved.

In this electron multiplier, each dynode plate has an engaging member at a predetermined position of a side surface of the plate to engage with a corresponding connecting pin for applying a predetermined voltage. Therefore, the engaging member is projecting in a vertical direction to the incident direction of the photoelectrons. The engaging member is constituted by a pair of guide pieces for guiding the connecting pin. On the other hand, a portion near the end portion of the connecting pin, which is brought into contact with the engaging member, may be formed of a metal material having a rigidity lower than that of the remaining portion.

Each dynode plate is constituted by at least two plates, each having at least one opening for serving as the dynode and integrally formed by welding such that the openings are matched with each other to function as the dynode when the two plates are overlapped. To integrally form these two plates by welding, each of the plates has at least one projecting piece for welding the corresponding two plates. The side surface of the plate is located in parallel with respect to the incident direction of the photoelectrons.

The insulating member having a spherical shape or the like is in contact with the concave portion formed in each dynode plate. The insulating members are in contact with each other in the through hole extending through the concave portions formed in the main surfaces of the dynode plates. With this structure, the following effects can be obtained. A force applied in the stacking direction is mostly received by the series of insulating members, and no excess force is applied to the dynode plates. Since the insulating member is in contact with the concave portions in the dynode plates, the centers of the upper and lower insulating members coincide with the central portion of the through hole. As a result, positioning of the dynode plates in the horizontal direction can be easily performed. In addition, the edge portion of the opening is not pressed and deformed as in the prior art.

The contact portion between the insulating member and the concave portion is positioned in the direction of thickness of the dynode plate rather than the main surface of the dynode plate having the concave portion. Therefore, the intervals between the dynode plates can be substantially increased (FIGS. 8 and 9).

Discharge between the dynode plates is often caused due to dust or the like deposited on the surface of the insulating member. However, in the structure according to the present invention, intervals between the dynode plates are substantially increased, thereby obtaining a structure effective to prevent the discharge.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

An embodiment of the present invention will be described below with reference to FIGS. 2 to 15.

Figure 1:
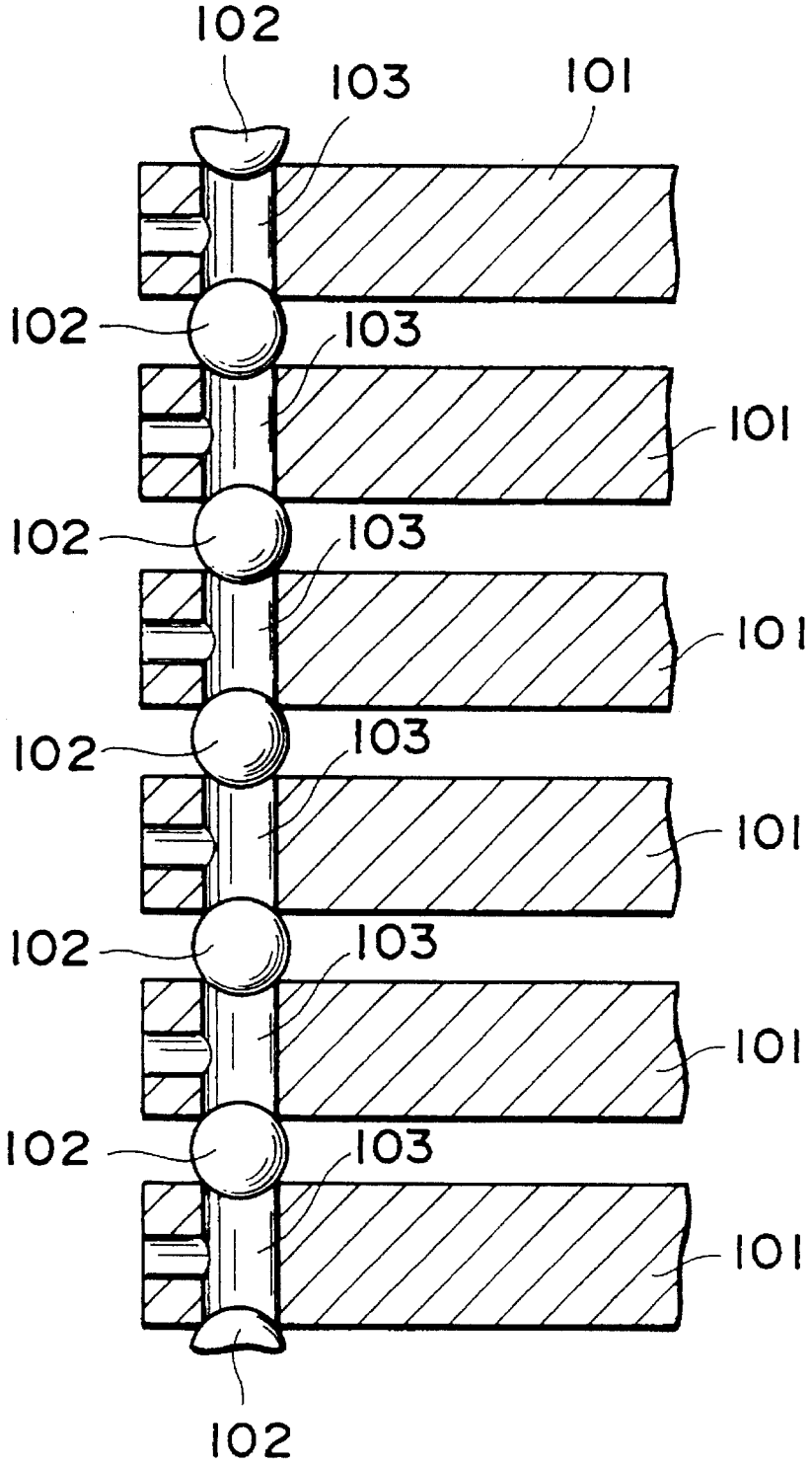
Fig. 1 (PRIOR ART)
FIG. 1 is a sectional view showing the structure of a conventional electron multiplier.
Figure 2:
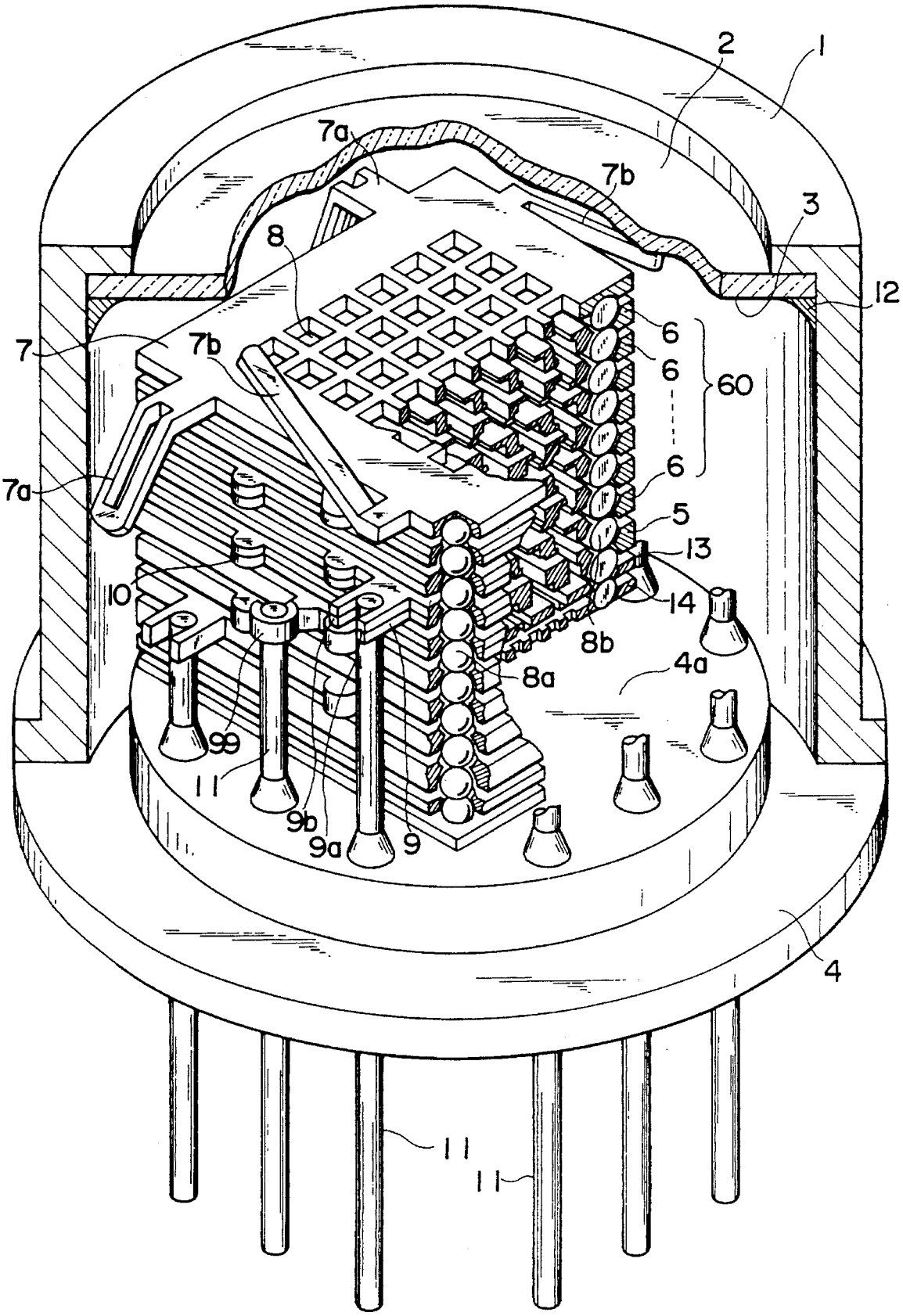
FIG. 2 is a partially cutaway perspective view showing the entire structure of a photomultiplier according to the present invention.

FIG. 2 is a perspective view showing the entire structure of a photomultiplier according to the present invention. Referring to FIG. 2, the photomultiplier is basically constituted by a photocathode 3 and an electron multiplier. The electron multiplier includes anodes (anode plate 5) and a dynode unit 60 arranged between the photocathode 3 and the anodes.

The electron multiplier is mounted on a base member 4 and arranged in a housing 1 which is formed integral with the base member 4 to fabricate a vacuum container. The photocathode 3 is arranged inside the housing 1 and deposited on the surface of a light receiving plate 2 provided to the housing 1. The anodes are supported by the anode plate 5 and arranged between the dynode unit 60 and the base member 4. The dynode unit 60 is constituted by stacking a plurality of stages of dynode plates 6, for respectively supporting a plurality of dynodes 603 (FIG. 3) for receiving and cascade-multiplying photoelectrons emitted from the photocathode 3, in the incidence direction of the photoelectrons.

The photomultiplier also has focusing electrodes 8 between the dynode unit 60 and the photocathode 3 for correcting orbits of the photoelectrons emitted from the photocathode 3. These focusing electrodes 8 are supported by a focusing electrode plate 7. The focusing electrode plate 7 is fixed on the electron incidence side of the dynode unit 60 through insulating members **8*a* and 8*b*. The focusing electrode plate 7 has holding springs 7*a* and contact terminals 7*b*, all of which are integrally formed with the electrode plate 7. The holding springs 7*a* are in contact with the inner wall of the housing 1 to hold the arrangement position of the dynode unit 60 fixed on the focusing electrode plate 7 through the insulating members 8*a* and 8*b*. The contact terminals 7*b* are in contact with the photocathode 3 to equalize the potentials of the focusing electrodes 8 and the photocathode 3 and functions as springs. When the focusing electrode plate 7 has no contact terminal 7*b*, the housing 1 may have an inner wall thereof deposited a conductive metal for applying a predetermined voltage to the photocathode 3, and the contact portion between the housing 1 and the photocathode 3 may be rendered conductive by a predetermined conductive metal 12 to equalize the potentials of the housing 1 and the photocathode 3. Although both the contact terminals 7*b* and the conductive metal 12 are illustrated in FIG. 2**, one structure can be selected and realized in an actual implementation.

The anode is supported by the anode plate 5. A plurality of anodes may be provided to this anode plate 5, and electron passage holes through which secondary electrons pass are formed in the anode plate 5 in correspondence with positions where the secondary electrons emitted from the last-stage dynode of the dynode unit 60 reach. Therefore, this photomultiplier has, between the anode plate 5 and the base member 4, an inverting dynode plate 13 for supporting inverting dynodes in parallel to the anode plate 5. The inverting dynode plate 13 inverts the orbits of the secondary electrons passing through the anode plate 5 toward the anodes. The diameter of the electron incident port (dynode unit 60 side) of the electron passage hole formed in the anode plate 5 is smaller than that of the electron exit port (inverting dynode plate 13 side). The inverting dynode plate 13 has, at positions opposing the anodes, a plurality of through holes for injecting a metal vapor to form a secondary electron emitting layer on the surface of each dynode 603 of the dynode unit 60.

On the other hand, the photomultiplier may have, between the inverting dynode plate 13 and the base member 4, a shield electrode plate 14 for supporting sealed electrodes in parallel to the inverting dynode plate 13. The shield electrode plate 14 inverts the orbits of the secondary electrons passing through the anode plate 5 toward the anodes. The shield electrode plate 14 has a plurality of through holes for injecting a metal vapor to form a secondary electron emitting layer on the surface of each dynode 603 of the dynode unit 60. In place of this shield electrode plate 14, a surface portion 4a of the base member 4 opposing the anode plate 5 may be used as a sealed electrode and substituted for the shield electrode plate 14.

In particular, the electron multiplier comprises a dynode unit 60 constituted by stacking a plurality of stages of dynode plates 6, spaced apart from each other at predetermined intervals by the insulating members **8*a* and 8*b* in the incidence direction of the electron flow, and each dynode plate 6 is supporting a plurality of dynodes 603 for cascade-multiplying an incident electron flow, and the anode plate 5 opposing the last-stage dynode plate 6 of the dynode unit 60 through the insulating members 8*a* and 8*b***.

In this electron multiplier, each dynode plate 6 has an engaging member 9 at a predetermined position of a side surface of the plate to engage with a corresponding connecting pin 11 for applying a predetermined voltage. The side surface of the dynode plate 6 is in parallel with respect to the incident direction of the photoelectrons. The engaging member 9 is constituted by a pair of guide pieces **9*a* and 9*b* for guiding the connecting pin 11. The engaging member may have a hook-like structure (engaging member 99 illustrated in FIG. 2). The shape of this engaging member is not particularly limited as long as the connecting pin 11 is received and engaged with the engaging member. On the other hand, a portion near the end portion of the connecting pin 11, which is brought into contact with the engaging member 9**, may be formed of a metal material having a rigidity lower than that of the remaining portion.

Each dynode plate 6 used is constituted by two plates **6*a* and 6*b* (FIG. 3) having openings for forming the dynodes and integrally formed by welding such that the openings are matched with each other to function as dynodes when the two plate overlap each other. To integrally form the two plates 6*a* and 6*b* by welding, the two plates 6*a* and 6*b* have projecting pieces 10 for welding the corresponding projecting pieces thereof at predetermined positions matching when the two plates 6*a* and 6*b*** are overlapped each other.

Figure 3:
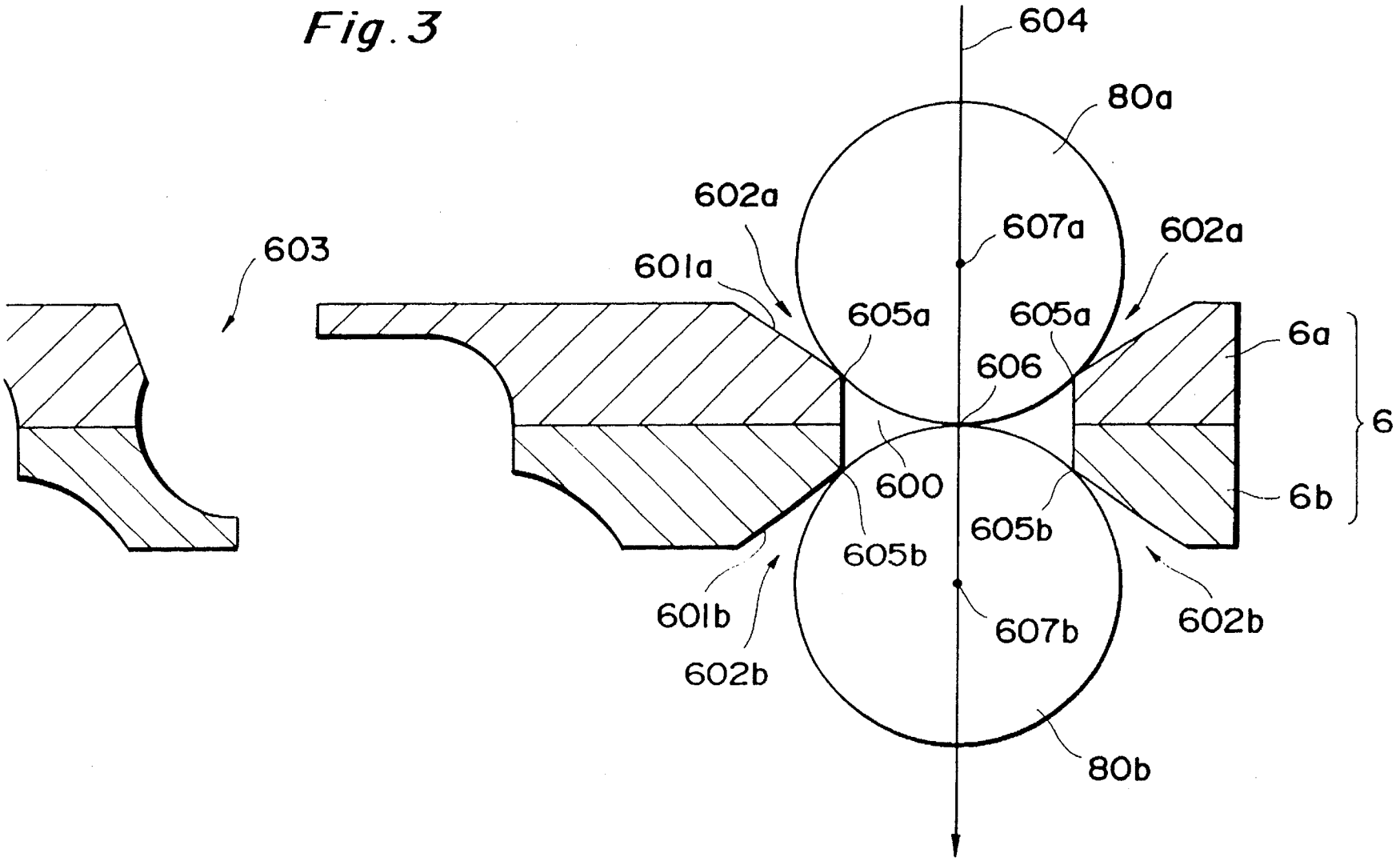
FIG. 3 is a sectional view showing a typical shape of a concave portion formed in a dynode plate in the photomultiplier according to the present invention.

The structure of each dynode plate 6 for constituting the dynode unit 60 will be described below. FIG. 3 is a sectional view showing the shape of the dynode plate 6. Referring to FIG. 3, the dynode-plate 6 has a first concave portion 601*a* in which a first insulating member 80*a*, which is disposed on a first main surface of the dynode plate 6 and partially in contact with the first concave portion 601*a*, and a second concave portion 601*b* in which a second insulating member 80*b*, which is disposed on a second main surface of the dynode plate 6 and partially in contact with the second concave portion 601*b* (the second concave portion 601*b* communicates with the first concave portion 601 through a through hole 600). The first insulating member 80*a* disposed in the first concave portion 601*a* and the second insulating member 80*b* disposed in the second concave portion 601*b* are in contact with each other in the through hole 600. An interval between the contact portion 605*a* between the first concave portion 601*a* and the first insulating member 80*a* and the contact portion 605*b* of the second concave portion 601*b* and the second insulating member 80*b* is smaller than that (thickness of the dynode plate 6) between the first and second main surfaces of the dynode plate 6.

Gaps 602*a* and 602*b* are formed between the surface of the first insulating member 80*a* and the main surface of the first concave portion 601*a* and between the second insulating member 80*b* and the main surface of the second concave portion 601*b*, respectively, to prevent discharge between the dynode plates 6. A central point 607*a* of the first insulating member 80*a*, a central point 607*b* of the second insulating member 80*b*, and a contact point 606 between the first and second insulating members 80*a* and 80*b* are aligned on the same line 604 in the stacking direction of the dynode plates 6 so that the intervals between the dynode plates 6 can be sufficiently kept.

The spherical bodies 8*a* or circularly cylindrical bodies 8*b* are used as the first and second insulating members 80*a* and 80*b* (insulating members 8*a* and 8*b* in FIG. 2). When circularly cylindrical bodies are used, the side surfaces of the circularly cylindrical bodies are brought into contact with each other. The shape of the insulating member is not limited to this. For example, an insulating member having an elliptical or polygonal section can also be used as long as the object of the present invention can be achieved. Referring to FIG. 3, reference numeral 603 denotes a dynode. A secondary electron emitting layer containing an alkali metal is formed on the surface of this dynode.

The shapes of the concave portion will be described below with reference to FIGS. 4 to 7. For the sake of descriptive convenience, only the first main surface of the dynode plate 6 is disclosed in FIGS. 4 to 7.

Figure 4:
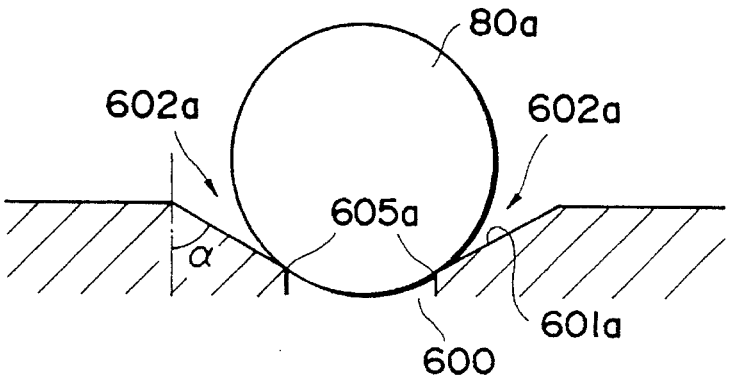
FIG. 4 is a sectional view showing the first shape of the concave portion as a first application of the concave portion shown in FIG. 3.

The first concave portion 601*a* is generally constituted by a surface having a predetermined taper angle (α) with respect to the direction of thickness of the dynode plate 6, as shown in FIG. 4.

Figure 5:
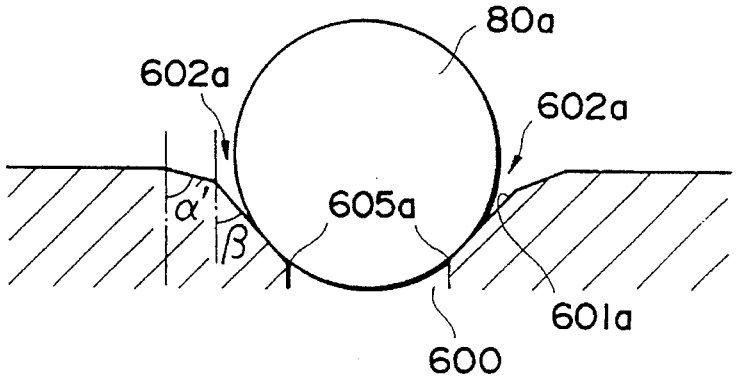
FIG. 5 is a sectional view showing the second shape of the concave portion as a second application of the concave portion shown in FIG. 3.

This first concave portion 601*a* may be constituted by a plurality of surfaces having predetermined taper angles (α and β) with respect to the direction of thickness of the dynode plate 6, as shown in FIG. 5.

Figure 6:
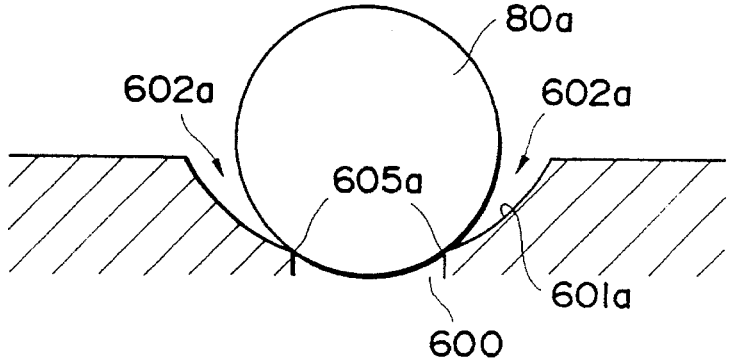
FIG. 6 is a sectional view showing the third shape of the concave portion as a third application of the concave portion shown in FIG. 3.

The surface of the first concave portion 601*a* may be a curved surface having a predetermined curvature, as shown in FIG. 6. The curvature of the surface of the first concave portion 601*a* is set smaller than that of the first insulating member 80*a*, thereby forming the gap 602*a* between the surface of the first concave portion 601*a* and the surface of the first insulating member 80*a*.

Figure 7:
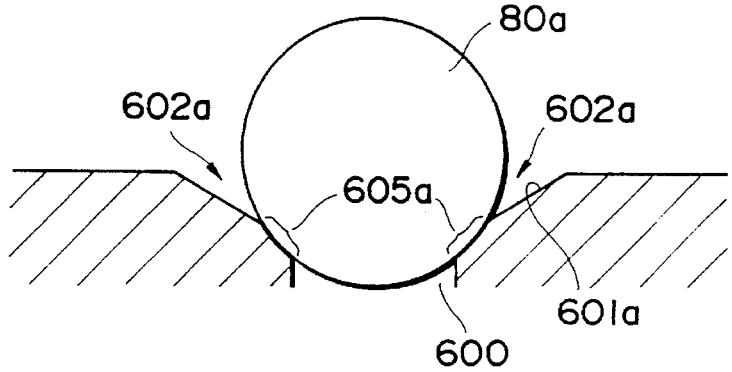
FIG. 7 is a sectional view showing the fourth shape of the concave portion as a fourth application of the concave portion shown in FIG. 3.

To obtain a stable contact state with respect to the first insulating member 80*a*, a surface to be brought into contact with the first insulating member 80*a* may be provided to the first concave portion 601*a*, as shown in FIG. 7. In this embodiment, a structure having a high mechanical strength against a pressure in the direction of thickness of the dynode plate 6 even compared to the above-described structures in FIGS. 4 to 6 can be obtained.

Figure 8:
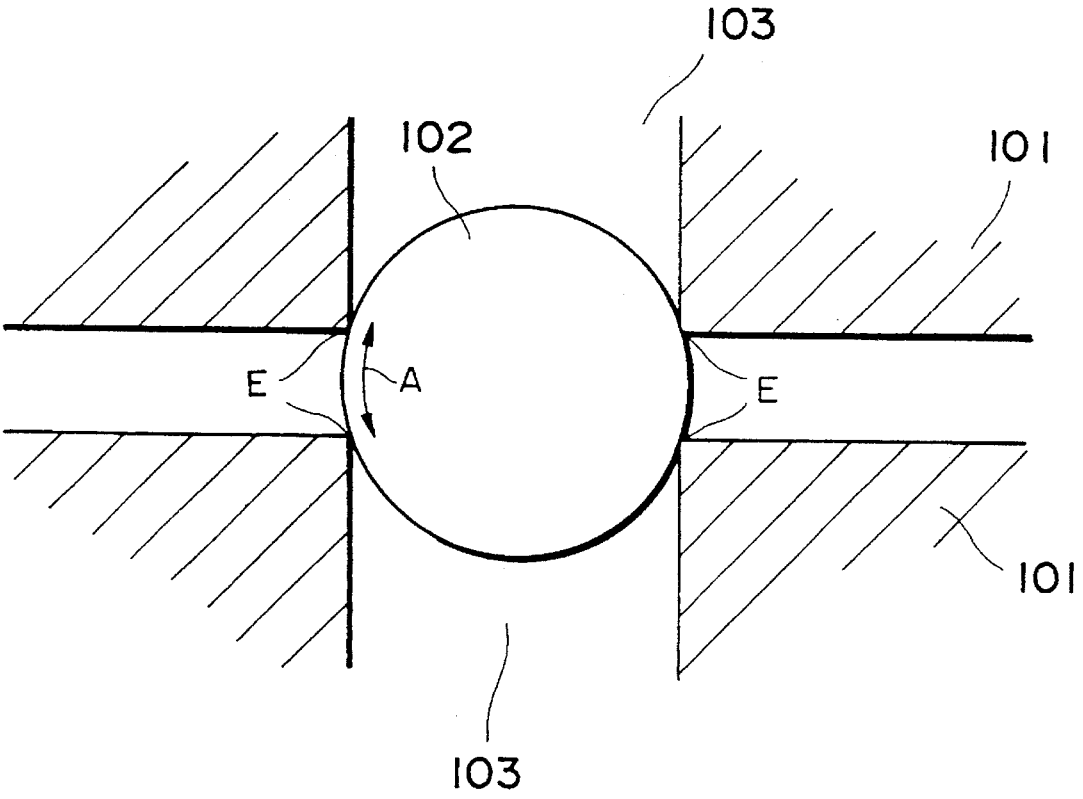
Fig. 8 (PRIOR ART)
FIG. 8 is a sectional view showing the structure between dynode supporting members in the conventional photomultiplier as a comparative example for explaining the effect of the present invention.
Figure 9:
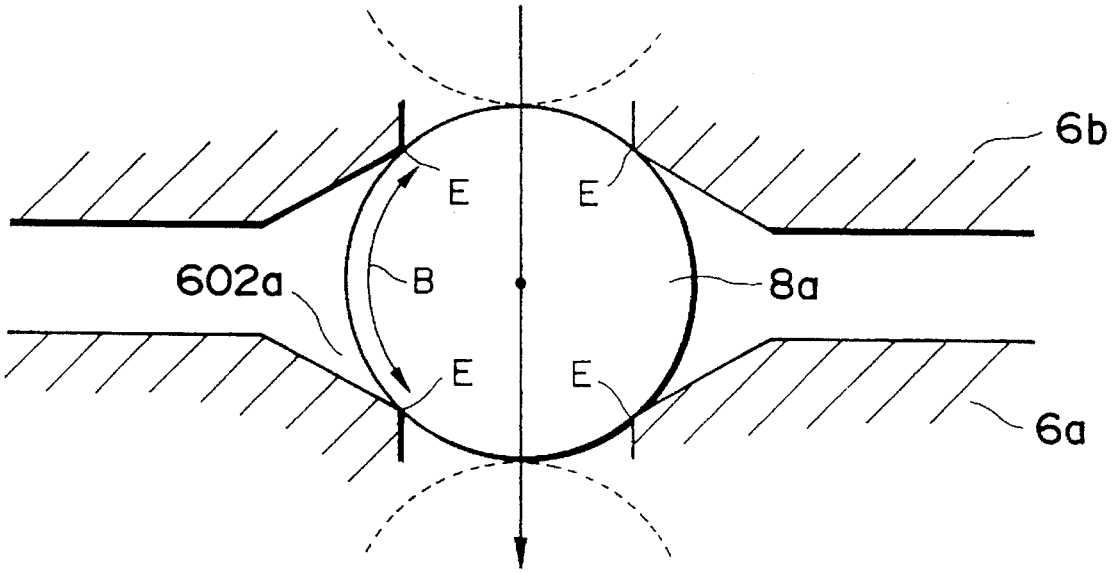
FIG. 9 is a sectional view showing the structure between the dynode plates for explaining the effect of the present invention.

The detailed structure between the dynode plates 6, adjacent to each other, of the dynode unit 60 will be described below with reference to FIGS. 8 and 9. FIG. 8 is a partial sectional view showing the conventional photomultiplier as a comparative example of the present invention. FIG. 9 is a partial sectional view showing the photomultiplier according to an embodiment of the present invention.

In the comparative example shown in FIG. 8, the interval between the support plates 101 having no concave portion is almost the same as a distance A (between contact portions E between the support plates 101 and the insulating member 102) along the surface of the insulating member 102.

On the other hand, in an embodiment of the present invention shown in FIG. 9, since concave portions are formed, a distance B (between the contact portions E between the plates 6*a* and 6*b* and the insulating member 8*a*) along the surface of the insulating member 8*a* is larger than the interval between plates 6*a* and 6*b*. Generally, discharge between the plates 6*a* and 6*b* is assumed to be caused along the surface of the insulating member 8*a* due to dust or the like deposited on the surface of the insulating member 8*a*. Therefore, as shown in this embodiment (FIG. 9), when the concave portions are formed, the distance B along the surface of the insulating member 8*a* is substantially larger than the interval between the plates 6*a* and 6*b*, thereby preventing discharge which occurs when the insulating member 8*a* is inserted between the plates 6*a* and 6*b*.

The present invention will be described in more detail.

Figure 10:
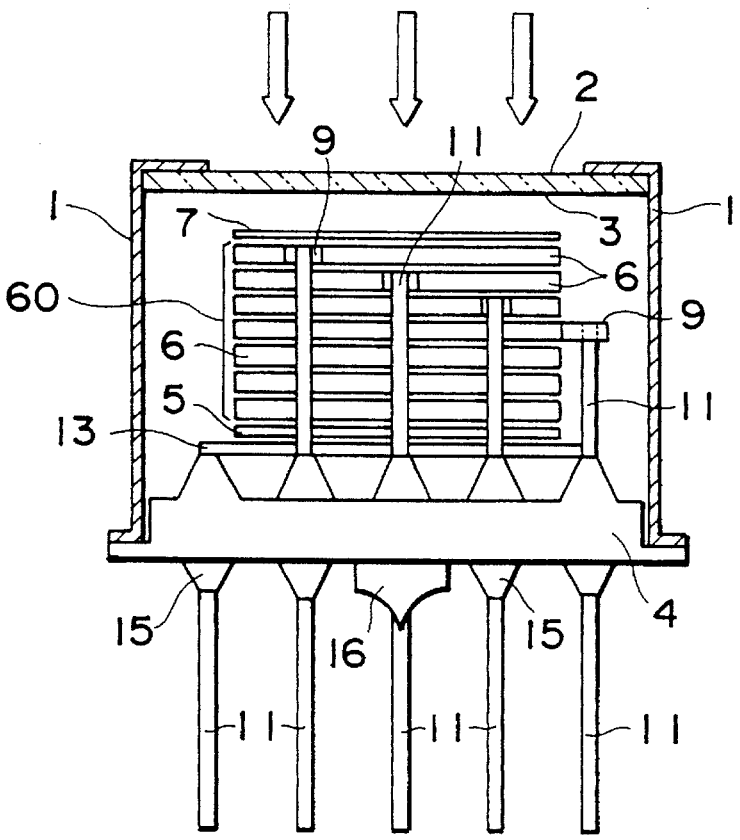
FIG. 10 is a sectional side view showing the simple internal structure of the photomultiplier, in which a metal housing 1 in the photomultiplier according to the present invention is cut.
Figure 11:
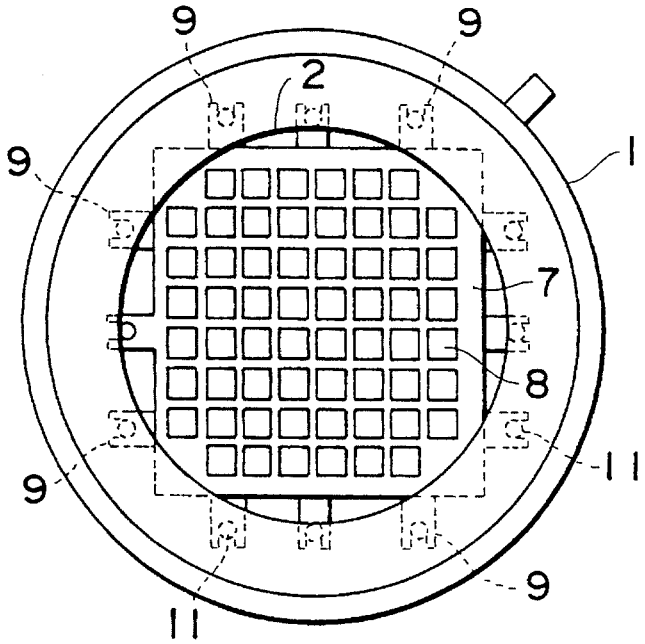
FIG. 11 is a plan view showing the photomultiplier according to the present invention shown in FIGS. 2 and 10.

FIGS. 10 and 11 are sectional and plan views, respectively, showing the photomultiplier according to this embodiment. In this photomultiplier, a vacuum container is fabricated by the circular light receiving plate 2 for receiving the incident light, the cylindrical metal housing 1 disposed along the outer circumference of the light receiving plate 2, and the circular stem 4 for constituting the base member. The electron multiplier for cascade-multiplying the incident electron flow is disposed in this vacuum container.

This electron multiplier includes the dynode unit 60 and the anodes supported by the anode plate 5.

The photocathode 3 is provided on the lower surface of the light receiving plate 2. The focusing electrode plate 7 for supporting the focusing electrodes 8 is disposed between the photocathode 3 and the electron multiplier. Therefore, the orbits of the photoelectrons emitted from the photocathode 3 are focused and incident on a predetermined region of the electron multiplier by the focusing electrodes 8.

In the electron multiplier, the dynode unit 60 is constituted by stacking a plurality of stages of dynode plates 6 for respectively supporting the dynodes, and the anode plate 5 for supporting the anodes and the inverting dynode plate 13 for supporting the inverting dynodes are sequentially disposed under the dynode unit 60.

Twelve connecting pins 11 which are connected to an external voltage applying terminals to apply a predetermined voltage to the dynode plates 6 and 13 extend through the stem 4 serving as the base member. Each connecting pin 11 is fixed to the stem 4 at a predetermined portion by hermetic glass 15. The length from the stem 4 to the distal end of each connecting pin 11 changes depending on the dynode plates to be connected. The distal end of each connecting pin 11 is resistance-welded to the connecting terminal (engaging member 9) of the corresponding dynode plate 6.

Figure 12:
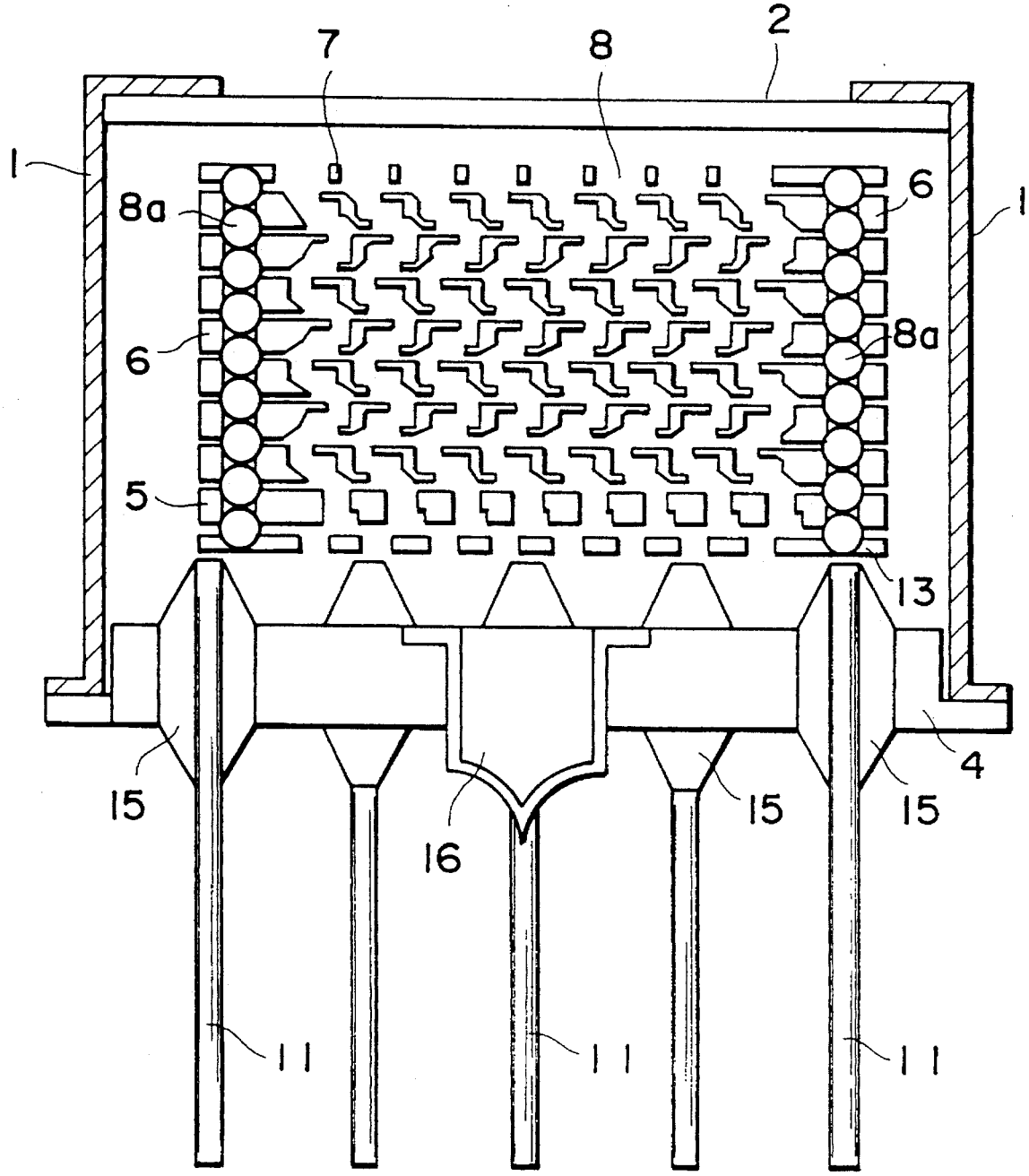
FIG. 12 is a sectional side view particularly showing an electron multiplier in the photomultiplier shown in FIG. 10.

FIG. 12 is an enlarged sectional view particularly showing the electron multiplier in this photomultiplier. The focusing electrode plate 7 for supporting the focusing electrodes 8, the dynode plates 6 for supporting the dynodes 603 for constituting the electron multiplier, the inverting dynode plate 13, and the anode plate 5 for supporting the anodes are stacked at predetermined intervals through the ceramic insulating balls 8*a*. The plurality of insulating balls 8*a* are arranged along the edges of the dynode plates 6.

Figure 13:
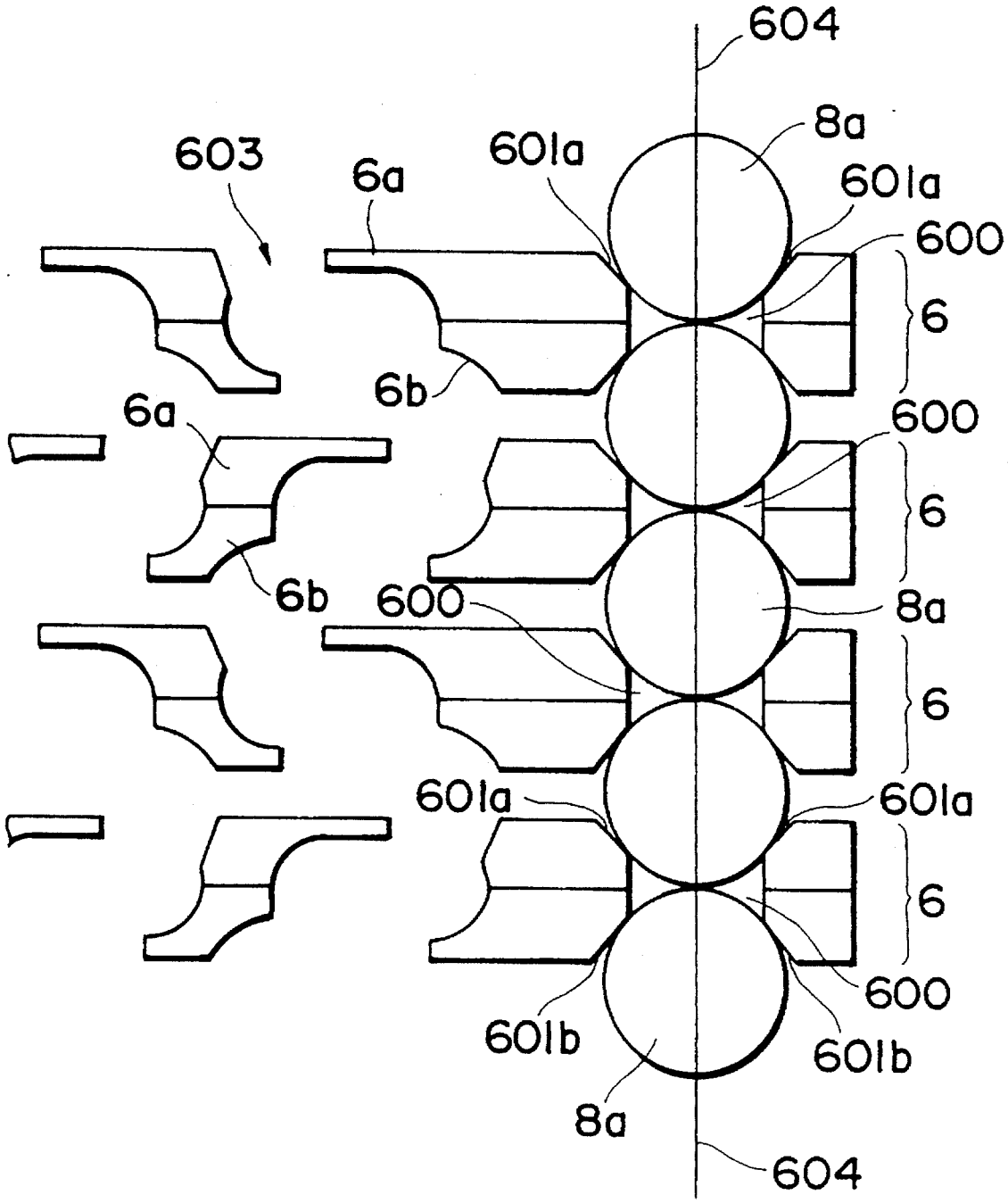
FIG. 13 is an enlarged sectional view showing part of a dynode unit.
Figure 14:
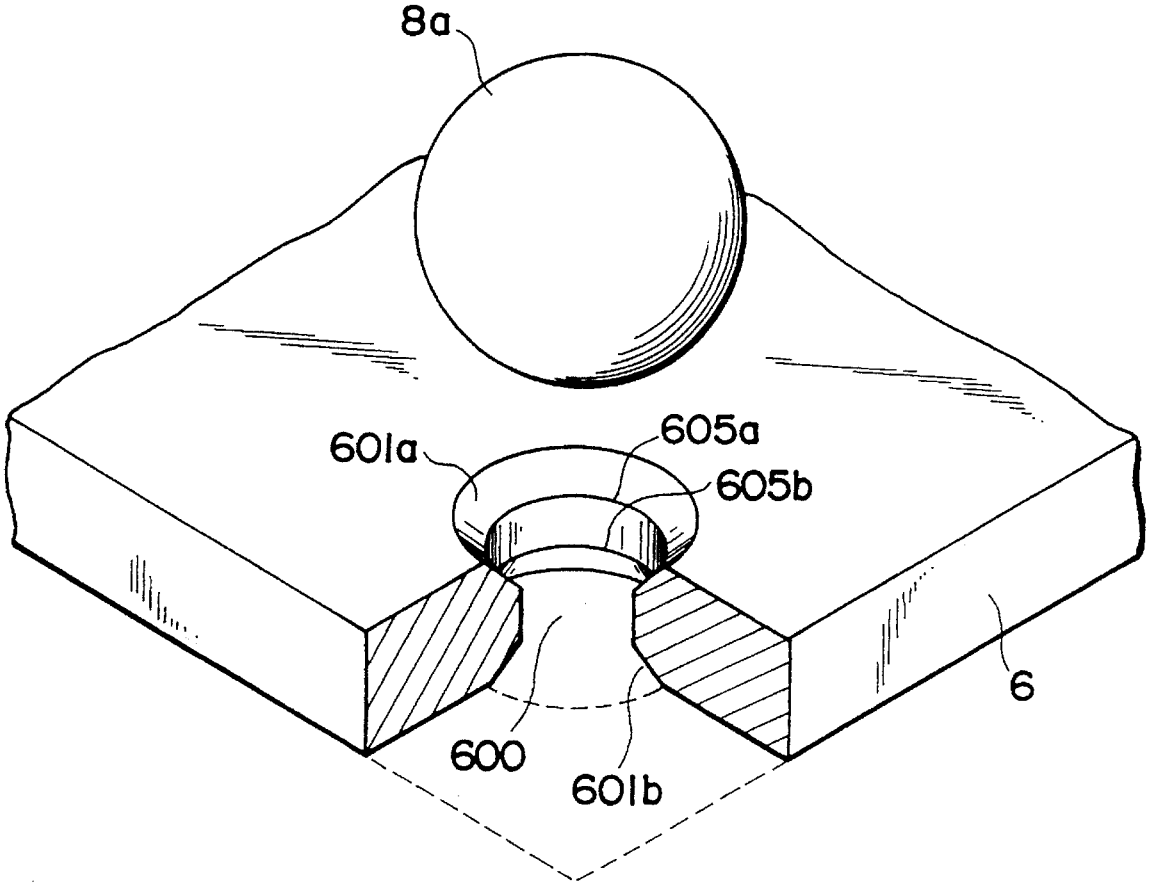
FIG. 14 is an enlarged perspective view showing the first structure of the dynode plate and an insulating member.

FIG. 13 is an enlarged sectional view showing the dynode unit 60. Each dynode plate 6 is constituted by an upper electrode (first plate 6*a*) and a lower electrode (second plate 6*b*) which are bonded to each other. The dynode 603 having a curved inner surface is formed in the plates 6*a* and 6*b*. The through hole 600 which extends from the concave portion 601*a* of the first plate 6*a* to the concave portion 601*b* of the second plate 6*b* is formed at a portion where the insulating ball 8*a* is disposed. Therefore, the upper and lower portions of the insulating balls 8*a* are fit in the concave portion 601*a* of the upper-stage dynode plate 6 and the concave portion 601*b* of the lower-stage dynode plate 6, respectively (FIG. 14), to engage with the upper- and lower-stage dynode plates 6.

In the through hole 600, the upper and lower insulating balls 8*a* are in contact with each other. As a result, the central points of the series of insulating balls 8*a* are aligned on the same line 604. In all dynode plates 6, the through hole 600 has a uniform diameter, the concave portions 601*a* and 601*b* have the same size, and the surfaces of the concave portions have the same taper angle with respect to the line 604. The insulating balls 8*a* opposing each other also have the same size (diameter). Therefore, the central axis of the through holes 600 always matches the central points of the insulating balls 8*a*. As a result, the dynode plates 6 are not displaced from the inverting dynode plate 13 in the horizontal direction, and predetermined intervals can be obtained. In this embodiment, the insulating balls 8*a* having a diameter of 0.66 mm are used, and the interval between the dynode plates 6 which are adjacent in the vertical direction is 0.25 mm. With this structure, the dynode plates 6, the inverting dynode plate 13, the anode plate 5, and the focusing electrode plate 7 can be easily and correctly assembled.

The distance between the dynode plates 6 along the surface of the insulating ball 8*a* increases as compared to the prior art (FIGS. 8 and 9). As a result, discharge which occurs along the surface of the insulating member 8*a* can be prevented to reduce the noise caused due to this discharge.

Figure 15:
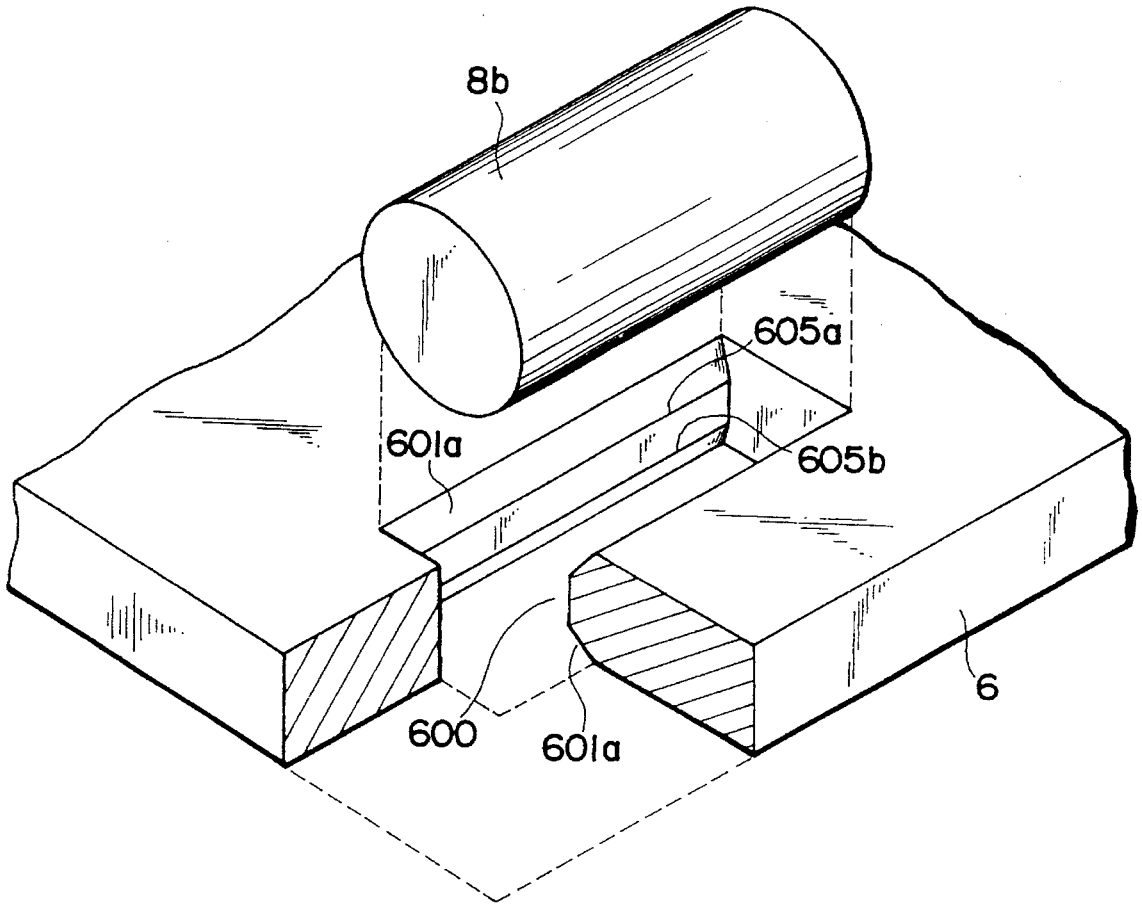
FIG. 15 is an enlarged perspective view showing the second structure of the dynode plate and an insulating member.

In this embodiment, the insulating ball 8*a* is used as an insulating spacer. However, it is not limited to the ball, and a circularly cylindrical insulating body 8*b* may be formed, as shown in FIG. 15. Also with this shape, the same function and effect can be obtained. In this case, the corresponding concave portions 601*a* and 601*b* of the dynode plates 6 can be formed to have shapes/positions which fit the outer surface of this circularly cylindrical body 8*b*.

In addition, in this embodiment, a concave portion is formed in the dynode plate 6 for supporting the dynodes. However, a similar concave portion may be formed at a predetermined position of a member for constituting a single dynode.

In the photomultiplier according to the present invention, an insulating spacer disposed between the two dynode plates is formed into a spherical or circularly cylindrical body (to be referred to as the spherical body or the like hereinafter), and the spherical body or the like is received by the side surfaces of the concave portions formed in the dynode plates. With this structure, the contact portion with respect to the spherical body or the like is not pressed and deformed, unlike in the prior art. The spherical bodies are brought into contact with each other in the through hole. For this reason, even when a force is applied to the spherical body or the like in the stacking direction, this force is mostly applied to a series of spherical bodies or the like to prevent the deformation of the dynode plates. Therefore, predetermined intervals between the dynode plates can be kept. Since no burr is formed at the edge portion of the through hole, unlike in the prior art, the noise caused due to the field concentration is reduced, and variations in the multiplication factor (gain) can also be minimized.

The center of each ball or the like matches with the center of each through hole when the dynode plates are stacked. Therefore, deviations of the dynode plates in the horizontal direction can be prevented to minimize variation in the multiplication factor.

In the prior art, the edge portion of the through hole is in direct contact with the spherical body. However, in the present invention, the side surfaces of the concave portions formed in the dynode plates are brought into contact with the spherical body or the like. Therefore, the distance between the dynode plates along the surface of the spherical body can be increased as compared to the prior art. For this reason, discharge along the surface of the ball can be prevented to minimize the noise.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An electron multiplier comprising a dynode unit for cascade-multiplying incident electrons, said dynode unit comprising:

a plurality of stacked stages of dynode plates; and insulating members separating said dynode plates, said dynode plate having a depression in which one of said insulating members is disposed, formed on a first main surface of said dynode plate, wherein an interval from a connect portion between said depression and said insulating member to a second main surface of said dynode plate opposing said first main surface is smaller than that from said second surface to said first surface; and wherein said insulating members are in contact at contact points on a surface of said members, wherein said contact points define a substantially straight line.

2. An electron multiplier comprising a dynode unit including a plurality of stacked stages of dynode plates, said dynode plates being spaced apart from each other at predetermined intervals by insulating members in an incidence direction of electrons, for respectively supporting at least one dynode for cascade multiplying incident electrons, each of said dynode plates having a first depression in which a first insulating member is provided, said first depression being formed on a first main surface of said dynode plate and said first insulating member is in partial contact with said first depression; and a second depression in which a second insulating member is provided, said second depression being formed on a second surface of said dynode plate opposing said first main surface, said second insulating member being in partial contact with said second depression, said second depression communicating with said first depression through a through hole, wherein said first insulating member and said second insulating member are in direct contact with each other in said through hole; and wherein said insulating members are in contact at contact points on a surface of said members, wherein said contact points define a substantially straight line.

3. An electron multiplier according to claim 1, wherein said insulating member is spaced apart from said first main surface of said dynode plate by a predetermined interval.

4. An electron multiplier according to claim 2, wherein an interval between a contact portion between said first depression and said first insulating member and a contact portion between said second depression and said second insulating member is smaller than an interval between said first and second main surfaces of said dynode plate.

5. An electron multiplier according to claim 2, wherein said first insulating member is spaced apart from said first main surface of said dynode plate at a predetermined interval, and wherein said second insulating member is spaced apart from said second main surface of said dynode plate at a predetermined interval.

6. An electron multiplier comprising:

a dynode unit comprising:

a plurality of stacked stages of dynode plates, said dynode plates being spaced apart from each other by predetermined intervals using insulating members as spacers in an incidence direction of the electrons, for respectively supporting at least one dynode for cascade-multiplying incident electrons, each of said dynode plates having a first depression supporting a first insulating member and being provided on a first main surface of said dynode plate and said first insulating member is in partial contact with said first depression; and a second depression supporting a second insulating member and being provided on a second main surface opposing said first main surface and said second insulating member is in partial contact with said second depression, said second depression communicating with said first depression through a through hole, wherein an interval between a contact portion between said first depression and said first insulating member and a contact portion between said second depression and said second insulating member is smaller than that between said first and second main surfaces of each of said dynode plates; and wherein said insulating members are in contact at contact points on a surface of said members, wherein said contact points define a substantially straight line.

7. A multiplier according to claim 6, wherein a central point of said first insulating member, a central point of said second insulating member, and a contact point between said first and second insulating members are aligned on the same line in a stacking direction of said dynode plates.

8. A multiplier according to claim 6 wherein said first and second insulating members are spherical bodies.

9. A multiplier according to claim 6 wherein said first and second insulating members are circularly cylindrical bodies, and outer surfaces of said circularly cylindrical bodies are in contact with each other.

10. A multiplier according to claim 6, wherein each of said dynode plates has an engaging member engaged with a corresponding connection pin for applying a predetermined voltage at a predetermined position of a side surface of said dynode plate, said side surface being parallel to the incident direction to said electrons.

11. A multiplier according to claim 10, wherein said engaging member comprises a pair of guide pieces for guiding said corresponding connecting pin.

12. A photomultiplier according to claim 6, wherein each of said dynode plates includes at least two plates integrally connected to one another.

13. A photomultiplier according to claim 12, wherein each of said two plates has at least one projecting piece at a predetermined position from a side surface thereof, said projecting piece being substantially perpendicular to the incident direction of said electrons.

14. An electron multiplier according to claim 6, wherein said first insulating member is spaced apart from said first main surface of said dynode plate by a first predetermined interval, and wherein said second insulating member is spaced apart from said second main surface of said dynode plate by a second predetermined interval.

15. An electron multiplier according to claim 6, wherein said first insulating member and said second insulating member are in direct contact with each other in said through hole.

16. A photomultiplier comprising:

a photocathode;

an anode plate for supporting at least one anode; and a dynode unit provided between said photocathode and said anode plate, said dynode unit comprising a plurality of stacked stages of dynode plates, said dynode plates spaced apart from each other at predetermined intervals via insulating members that separate said dynode plates in an incident direction of photoelectrons emitted from said photocathode, for respectively supporting at least one dynode for cascade-multiplying said photoelectrons, wherein each of said dynode plates has a first depression supporting a first insulating member and being provided on a first main surface of said dynode plate, said first insulating member being in partial contact with said first depression; and a second depression supporting a second insulating member and being provided on a second main surface opposing said first main surface, said second insulating member being in partial contact with said second depression, said second depression communicating with said first depression through a through hole, wherein said first insulating member and said second insulating member are in direct contact with each other in said through hole; and wherein said insulating members are in contact at contact points on a surface of said members, wherein said contact points define a substantially straight line.

17. A photomultiplier according to claim 16, wherein a central point of said first insulating member, a central point of said second insulating member, and a contact point between said first and second insulating members are aligned on the same line in a stacking direction of said dynode plates.

18. A photomultiplier according to claim 16, wherein said first and second insulating members are spherical bodies.

19. A photomultiplier according to claim 16, wherein said first and second insulating members are circularly cylindrical bodies, and outer surfaces of said circularly cylindrical bodies are in contact with each other.

20. A photomultiplier according to claim 16, further comprising focusing electrode plate for supporting at least one focusing electrode between said photocathode and projecting piece being substantially perpendicular to the incident direction of said photoelectron.

21. A photomultiplier according to claim 20, wherein said focusing electrode plate has at least one contact terminal which is in contact With said photocathode to equalize potential of said focusing electrode and said photocathode, and said contact terminal and said focusing electrode plane being integrally formed.

22. A photomultiplier according to claim 16, wherein each of said dynode plates has an engaging member engaged with a corresponding connecting pin for applying a predetermined voltage at a predetermined position of a side surface of said plate, said side surface in parallel to the incident direction of said photoelectrons.

23. A photomultiplier according to claim 22, wherein said engaging member is constituted by a pair of guide pieces for guiding said corresponding connecting pin.

24. A photomultiplier according to claim 16, wherein an interval between a contact portion between said first concave portion and said first insulating member and a contact portion between said second concave portion and said second insulating member is smaller than an interval between said first and second main surface of said dynode plate.

25. A photomultiplier according to claim 16, wherein said first insulating member is spaced apart from said first main surface of said dynode plate by a first predetermined interval, and wherein said second insulating member is spaced apart from said second main surface of said dynode plate by a second predetermined interval.

26. A photomultiplier according to claim 16, wherein each of said dynode plates includes at least two plates integrally connected to each other, each having at least one opening for forming said dynode.

27. A photomultiplier according to claim 26, wherein each of said two plates has at least one projecting piece at a predetermined position of side surface thereof, said projecting piece being substantially perpendicular to the incident direction of said photoelectrons.

28. A photomultiplier comprising:

a photocathode;

an anode plate for supporting at least one anode; and a dynode unit provided between said photocathode and said anode plate and comprising a plurality of stacked stages of dynode plates, said dynode plates for respectively supporting at least one dynode for receiving and cascade-multiplying photoelectrons emitted from said photocathode in an incidence direction of said photoelectrons, wherein each of, said dynode plates has a first depression supporting a first insulating member and being provided on a first main surface of said dynode plate, said first insulating member being in partial contact with said first depression; and a second depression supporting a second insulating member and being provided on a second main surface opposing said first main surface, said second insulating member being in partial contact with said second depression, said second depression communicating with said first depression through a through hole, wherein an interval between a contact portion between said first depression and said first insulating member and a contact portion between said second depression and said second insulating member is smaller than an interval between said first and second main surfaces of each of said dynode plates; and wherein said insulating members are in contact at contact points on a surface of said members, wherein said contact points define a substantially straight line.

29. A photomultiplier according to claim 28, wherein a central point of said first insulating member, a central point of said second insulating member, and a contact point between said first and second insulating members are aligned on the same line in a stacking direction of said dynode plates.

30. A multiplier according to claim 28, wherein said first and second insulating members are spherical bodies.

31. A multiplier according to claim 28, wherein said first and second insulating members are circularly cylindrical bodies, and outer surfaces of said circularly cylindrical bodies are in contact with each other.

32. A photomultiplier according to claim 28, further comprising a housing, wherein a conductive metal for applying a predetermined voltage to said photocathode is deposited on an inner wall of said housing, and said housing and said photocathode are rendered conductive by a predetermined conductive metal.

33. A photomultiplier according to claim 28, further comprising a focusing electrode plate for supporting at least one focusing electrode between said photocathode and said dynode unit and for correcting orbits of incident electrons, said focusing electrode plate being provided on an electron incidence side of said dynode unit while being spaced apart from said dynode unit at a predetermined interval.

34. A photomultiplier according to claim 33, wherein said focusing electrode plate has at least one contact terminal which is in contact with said photocathode to equalize potentials of aid at least one focusing electrode and said photocathode.

35. A photomultiplier according to claim 28, wherein each of said dynode plates has an engaging member engaged with a corresponding connecting pin for applying a predetermined voltage at a predetermined position of a side surface of said plate, said side surface in parallel to the incident direction of said photoelectrons 36. A photomultiplier according to claim 35, wherein said engaging member is constituted by a pair of guide pieces for guiding said corresponding connecting pin.

37. A photomultiplier according to claim 35, wherein a portion near an end portion of said connecting pin, which is brought into contact with said engaging member, is formed of a metal material having a rigidity lower than that of a remaining portion.

38. A photomultiplier according to claim 29, wherein each of said dynode plates includes at least two plates integrally connected to each other, each having at least one opening for forming said dynode.

39. A photomultiplier according to claim 38, wherein each of said two plates has at least one projecting piece at a predetermined position of side surface thereof, said projecting piece being substantially perpendicular to the incident direction of said photoelectron.

40. A photomultiplier according to claim 35, wherein said first insulating member is spaced apart from said first main surface of said dynode plate by a first predetermined interval, and wherein said second insulating member is spaced apart from said second main surface of said dynode plate by a second predetermined interval.

41. A photomultiplier according to claim 35, wherein said first insulating member and said second insulating member are in direct contact with each other in said through hole.

* * * * *